United States Patent [19]

Kobayashi

[11] Patent Number: 4,735,072

[45] Date of Patent: Apr. 5, 1988

[54] STRAIGHTENER ROLL MACHINE FOR BRAKE SHOE

[75] Inventor: Shigeyoshi Kobayashi, Saitama, Japan

[73] Assignee: Akebono Brake Industry Co., Ltd., Tokyo, Japan

[21] Appl. No.: 913,420

[22] Filed: Sep. 30, 1986

[30] Foreign Application Priority Data

Oct. 1, 1985 [JP] Japan ..... 60-216213

[51] Int. Cl.[4] ..... B21D 5/14

[52] U.S. Cl. ..... 72/133; 72/166; 72/199

[58] Field of Search ..... 29/233, 402.19, 402.21; 72/101, 133, 166, 245, 246, 366, 465, 167, 168, 199

[56] References Cited

U.S. PATENT DOCUMENTS

| | | | |
|---|---|---|---|
| 2,093,933 | 9/1937 | Sinclair | 72/167 X |
| 2,202,230 | 5/1940 | Poux | 72/366 X |
| 2,649,129 | 8/1953 | Schlank | 72/101 |
| 2,922,324 | 1/1960 | Honerkamp et al. | 72/167 X |
| 3,438,231 | 4/1969 | Petzschke | 72/366 X |
| 4,266,417 | 5/1981 | Imamura et al. | 72/168 |

FOREIGN PATENT DOCUMENTS

| | | | |
|---|---|---|---|
| 2133016 | 1/1972 | Fed. Rep. of Germany | 72/166 |
| 1039607 | 9/1983 | U.S.S.R. | 72/166 |

*Primary Examiner*—E. Michael Combs

*Attorney, Agent, or Firm*—Finnegan, Henderson, Farabow, Garrett and Dunner

[57] ABSTRACT

A roll machine for straightening a brake shoe comprising a main roller and a dependent roll. The main roll has a groove into which the web of the brake shoe is fit and flanges slightly shorter than the thickness of the brake shoe film. The freely rotating dependent roll is hydraulically pressed against the turning main roll and brake shoe. A replaceable block is disposed between the hydraulic piston rod and the support of the dependent roll and a roller pin perpendicular to axis of the two rolls is placed in corresponding grooves of the block and dependent roll support.

6 Claims, 2 Drawing Sheets

STRAIGHTENER ROLL MACHINE FOR BRAKE SHOE

BACKGROUND OF THE INVENTION

1. Field of the Invention

This invention relates to a straightener roll machine for straightening the deformation of the rim of a brake shoe resulting from soldering a web to the rim of the brake shoe. More specifically, it relates to straightening the distortion of the rim and the twist thereof against the web.

2. Background Art

As shown in FIG. 5, a brake shoe is fabricated by welding the circular end face of a web 21 to the inner peripheral face of a rim 20. However, the rim 20 is prepared from a steel sheet and consequently the inner peripheral face of the rim 20 is barely secured to the side of the web 21 at a right angle. Moreover, the problem is that the circular face of the rim 20 may be distorted when both of them are welded together. In other words, the deformation, if any, of the rim 20 must be straightened.

Press machines and dies had once been used for straightening brake shoes but a roll system is now instead in use. The change in the use of machines and dies requires not only a greater percentage of floor area and space occupied but also increases the cost of equipment. Machines and dies also worsen the work environment due to the generation of noise and vibration.

The conventional roll system is characterized by the steps of fitting the web 21 of a brake shoe into a groove bored in a main roll, mating the under surface of a rim 20 with the surface of the main roll and sandwiching the rim 20 under pressure between the main roll and a dependent roll. More specifically, the main roll shaft is supported by a bearing fixed to a frame, whereas the dependent roll is supported by a bearing whose position is adjustable in the longitudinal direction relative to the frame so as to make adjustable the space between the main and dependent rolls according to the thickness of the rim 20.

The conventional roll system thus constructed allows the application of counterforce to the dependent roll at the time of straightening the brake shoe, thus failing to keep the dependent roll shaft parallel to the main roll shaft because of the movement of the bearing. For this reason, the uniform sizing of one and the other ends of the rim 20 becomes impossible and a great deal of skill not only has been required but also trouble occurs in order to adjust the dependent roll shaft and the main roll shaft to be in parallel with each other.

Moreover, it is certainly too troublesome to make fine adjustments as to the distance between the shafts of the main and dependent rolls in accordance with a subtle changing of the thickness of the rim 20. Furthermore, because the distance between the two rolls is left unadjusted within the range of roughly ±9% fluctuations in the thickness of the rim 20, the thickness of the rim 20 has affected finished products in such a manner as to cause differences in their quality.

SUMMARY OF THE INVENTION

The present invention is intended to solve the above problems.

The straightener roll machine according to the invention is constructed as follows. The straightener roll machine for a brake shoe includes a main roll pivotally carried by a frame fixed to a base in such a manner as to rotate on its own axis. The main roll has a groove for receiving the web of the brake shoe, has lands on both sides of the groove against which the inner peripheral face of a rim abuts and has a flange fixed to one side of each land. A dependent roll is pivotally carried by the base and is positioned opposite to the main roll. According to the invention, the difference in level between the land and the flange is slightly smaller than the thickness of the rim of the brake shoe. Also, the dependent roll is pivotally and rotatably supported by a dependent roll frame having a circular groove, in the center of its back surface, whose axis is perpendicular to the shafts of the main and dependent rolls. Its front end is resiliently supported by the base. Further, the roll frame is guided by a guide fixed to the base in the direction perpendicular to the dependent roll shaft. A block having a circular groove identical in shape with the circular groove in the dependent roll frame is detachably mounted on the piston rod of a hydraulic cylinder fixed to the base. A roller is installed in between the circular grooves of the block and the dependent roll frame.

Moreover, a buffer plate for offsetting the difference in level between the circumferential face of the flange and the outer peripheral face of the rim is fixed to the side of the flange.

BRIEF DESCRIPTION OF THE DRAWINGS

FIG. 1 is a plan view of the same.

FIG. 2 is sectional view taken on line II—II of FIG. 1.

FIG. 3 is a diagram of the dependent roll pressed against a brake shoe rim.

FIG. 4 is a diagram of a buffer plate fitted thereto.

DETAILED DESCRIPTION OF THE PREFERRED EMBODIMENT

Figure 1:
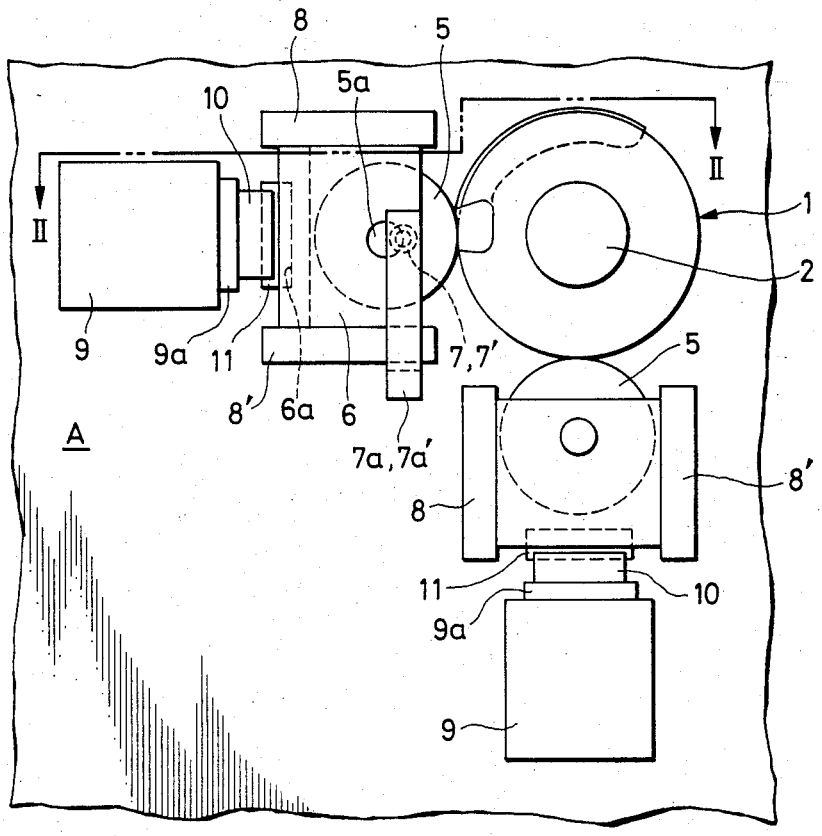
FIGS. 1 to 4 shows an embodiment of the straightener roll machine for a brake shoe according to the present invention.
Figure 2:
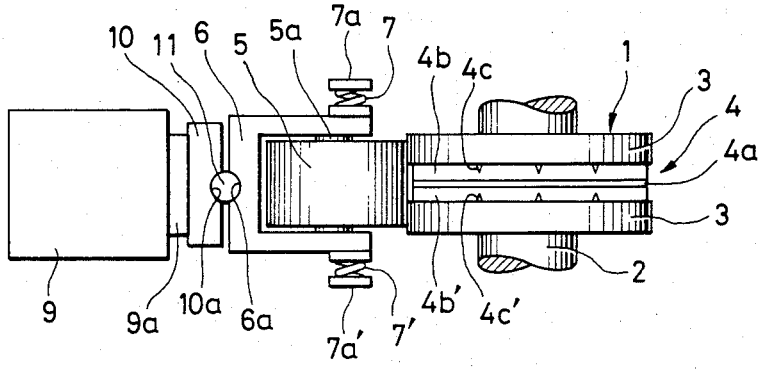
Figure 3:
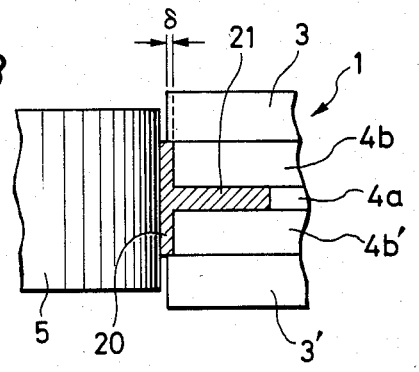

Referring now to FIGS. 1 through 3, a straightener roll machine for a brake shoe according to the present invention will be described.

For convenience of illustration, a plane A is used as a base. Needless to say, what is perpendicular to the plane A may be used to illustrate the above base.

The straightener roll machine according to the present invention comprises a main roll 1 whose shaft 2 is supported by a frame (not shown) fixed to the base A through a bearing and is rotatably driven by a motor (not shown). The main roll 1 includes flanges 3 and 3', and a means 4 for receiving a brake shoe and having, in its center, an annular groove **4*a* for receiving a web 21. Lands 4*b* and 4*b'* are installed on both sides of the groove 4*a*, each land having an annular face against which the inner peripheral face of a rim 20 is allowed to abut. Recesses 4*c* and 4*c'* in the main roll 1, respectively receive projections 20*a* and 20*a'* of the rim 20. The amount of recess δ between the flanges 3 and 3' and the lands 4*b* and 4*b'* is, as shown in enlarged drawing FIG. 3, slightly smaller than the thickness of the rim 20. This is intended to minimize the stroke of the dependent roll 5 and to make the dependent roll 5 instantly follow the pressure change by decreasing the projection of the outer peripheral face of the rim 20 from the circumferential face of the main roll 1. As seen in FIGS. 2 and 3, dependent roll 5 is in contact with the outer circumferential surfce of flanges 3 of main roll 1 until the rim of the barke shoe is interposed between main roll 1 and dependent roll 5. Without the recess of lands 4b, 4b', the stroke of dependent roll 5** would equal the full thickness of the brake shoe rim.

The straightener roll machine further comprises a dependent roll 5 pivotally supported on a U-shaped dependent roll frame 6 through its shaft 5a. Two dependent rolls 5 are shown in FIG. 1. A cylindrical depression 6a having its axis perpendicular to the shaft 5a of the dependent roll 5 and the shaft 2 of the main roll 1 is formed in the center of the rear face of the dependent roll frame 6. The front ends of both sides of the dependent roll frame 6 are resiliently supported by the base A. In other words, coil springs 7 and 7' are respectively placed between both sides of the dependent roll frame 6 and arms 7a and 7a' fixed onto the base A so as to suppress vibration in the direction of the shaft 5a of the dependent roll 5 and to properly position the dependent roll 5 relative to the base A.

The above straightener roll machine still further comprises guides 8 and 8' for slidably guiding the dependent roll frame 6 and which are fixed onto the base A at the both sides of the rotating dependent roll 5. A hydraulic cylinder 9 fixed onto the base A pushes a piston rod 9a and a block 10 installed on the front end of the piston rod 9a so as to adjust the position of the dependent roll to the varying thickness of the rim 20 of the brake shoe. A hub end type tail end of the block 10 is detachably attached to the dependent roll frame 6 with its front end being provided with a cylindrical depression 10a having the same diameter as that 6a of the dependent roll frame 6. As a result, a roller 11 having its axis perpendicular to those of the shaft 2 of the main roll and the shaft 5a of the dependent roll 5 can be installed in two cylindrical depressions 6a and 10a.

The operation of the straightener roll machine will now be described.

The web 21 of the brake shoe is inserted into the groove 4a of the main roll 1 and the rear side of the rim 20 is tightly attached to both lands 4b and 4b', so that the outer peripheral face of the rim 20 projects from the circumferential faces of both flanges 3 and 3' of the main roll 1.

The pressure oil is externally introduced to the hydraulic cylinder 9 to make the piston rod 9a, acting through the block 10 and the roller 11, to force out the dependent roll frame 6 as guided by the guides 8 and 8'. The dependent roll 5 is made to tightly contact the outer peripheral face of the rim 20 to turn the main roll 1. Then the rim 20 of the brake shoe is sandwiched in between the main roll 1 and the dependent roll 5 under pressure. The deformation of the rim 20 is thus straightened as the motor rotates the main roll 1.

When the dependent roll 5 is pressed against the rim 20, the action of the roller 11 is utilized to keep the shaft 5a of the dependent roll parallel to the shaft 2 of the main roll. The given hydraulic pressure in the cylinder is also used to apply fixed pressure to the rim 20 and the buffer action of the pressure oil is usable to deal with the slightly varying thickness of the rim 20.

By changing the block 10 when the main roll 1 is changed to another one having a different diameter, the straightener roll machine is applicable to a variety of brake shoes whose rims 20 are different in thickness from each other and brake shoes different in size and shape.

Figure 4:
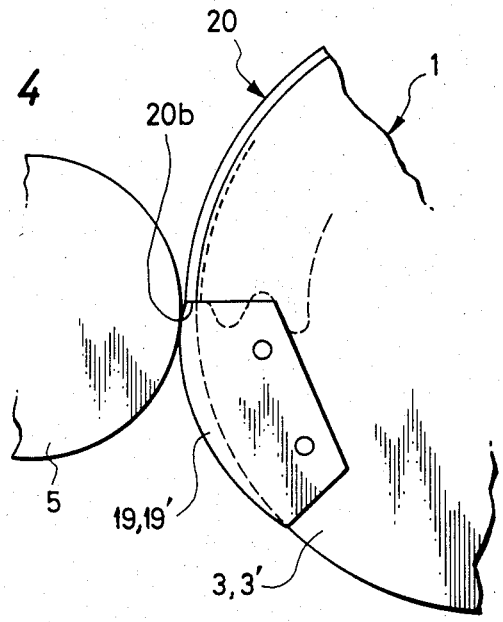
Figure 5:
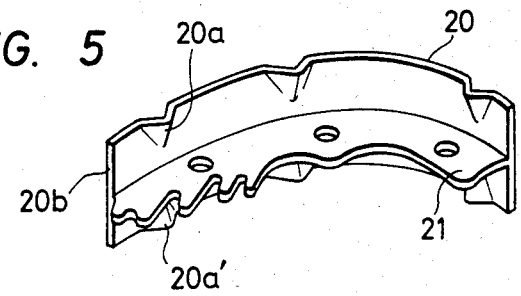
FIG. 5 is a perspective view of the brake shoe.

Although the straightener roll machine shown in FIG. 2 is equipped with two dependent rolls 5 for one main roll 1, only one dependent roll 5 may instead be installed. Further, as shown in FIG. 4, buffer plates 19 and 19' having gradually varying height may be fixed to the sides of the flanges 3 and 3' in order to offset the difference in level between the circumferential faces of the flanges 3 and 3' and the outer face of rim 20. When the rim 20 is abutted against the buffers 19 and 19', they prevent the dependent roll 5 from colliding with the front edge 20b of the rim 20.

In summary, the web of the brake shoe is fitted into the groove of the main roll and the inner peripheral face of the rim is made to abut against the lands, so that the outer peripheral face of the rim slightly projects from circumferential faces of both flanges of the main roll. The pressure oil is introduced from outside into the hydraulic cylinder to force out the dependent roll frame guided by the guides using the force of the piston rod through the block and the roller. The main roll is rotated by allowing the dependent roll to abut against the outer peripheral face of the rim. In consequence, the rim of the brake shoe is sandwiched under pressure between the main and dependent rolls. The deformation of the rim is thus straightened.

While the dependent roll is pressed against the rim, the shaft of the dependent roll is pressed against the rim, the shaft of the dependent roll is kept parallel to that of the main roll and applies give jamming force to the rim. Simultaneously, a slight difference in the thickness of the rim can be dealt with by the buffer action of the pressure oil.

Moreover, the installation of the buffer plate allows the dependent roll to abut against the front edge of the rim of the brake shoe without a shock.

As is readily understood from the above description, the following effects are achieved by the straightener roll machine for a brake shoe according to the present invention.

(i) The dependent roll is jammed on the rim of the brake shoe not because of the fixed gap between the main and dependent rolls but by the hydraulic power within the cylinder, so that the trouble attributed to the adjustment of the gap between the main and dependent rolls, requiring much skill, is remedied. Accordingly, such adjustment can be made simply by setting numerical values to a hydraulic gauge.

(ii) Since the shaft of the dependent roll can always be maintained in parallel to that of the main roll, both sides of the rim are straightened with equal accuracy.

(iii) Even though the thickness of the rim plate slightly varies, it can be dealt with by the buffer action of the pressure oil within the cylinder.

(iv) A variety of rims whose thicknesses differ can readily be dealt with by replacing the block with one different in thickness. Moreover, shoes different in size and shape can be straightened by replacing the main roll and the block.

What is claimed is:

1. A straightener roll machine for a brake shoe having a rim of a preselected thickness and a web, the machine comprising:

a main roll pivotally carried by a frame fixed to a base in such a manner as to rotate on its own axis, said main roll having a groove for receiving the web of the brake shoe, lands on both sides of said groove against which the inner peripheral face of the rim is abuttable. and a pair of equal-diameter flanges, each of said flanges being fixed to an outer side of one of said lands and having a radially outward circumferential face, said lands being recessed radially inward relative to said circumferential faces of said flanges by a distance smaller than the thickness of the rim of the brake shoe;

a dependent roll pivotally carried by the base and positioned facing said main roll;

a dependent roll frame pivotally and rotatably supporting said dependent roll, said dependent roll frame having a first circular depression on a side facing away from said main roll and having an axis perpendicular to said rotational axis of said main roll;

a hydraulic cylinder having a piston rod therein, said cylinder being fixed to said base and actuatable to move said dependent roll frame toward said main roll by movement of said piston rod;

a block mounted on an end of said piston rod toward said main roll and having a second circular depression facing said main roll; and a roller installed in said first and second circular depressions.

2. A straightener roll machine as recited in claim 1, wherein said block is detachably mounted on said piston rod.

3. A straightener roll machine as recited in claim 1, wherein there are two sets of said dependent roll, dependent roll frame, hydraulic cylinder, block and roller.

4. A straightener roll machine as recited in claim 1, further comprising a buffer plate of varying height fixed to an outer side of each of said flanges and extending radially beyond said circumferential face of said flange to guide said dependent roll gradually onto the outer peripheral face of the rim.

5. A straightener roll machine for a brake shoe having a rim and a web, the machine comprising:

a main roll pivotally carried by a frame fixed to a base in such a manner as to rotate on its own axis, said main roll having a groove for receiving the web of the brake shoe and lands on both sides of said groove against which the inner peripheral face of the rim is abuttable;

a dependent roll pivotably carried by the base and positioned facing said main roll;

a dependent roll frame pivotally and rotatably supporting said dependent roll, said dependent roll frame having a first circular depression on a side facing away from said main roll and having an axis perpendicular to said rotational axis of said main roll;

a hydraulic cylinder having a piston rod therein, said cylinder being fixed to said base and actuatable to move said dependent roll frame toward said main roll by movement of said piston rod;

a block mounted on an end of said piston rod toward said main roll and having a second circular depression facing said main roll; and a roller installed in said first and second circular depressions.

6. A straightener roll machine for a brake shoe having a rim of a preselected thickness and web, the machine comprising:

a main roll pivotally carried by a frame fixed to a base in such a manner as to rotate on its own axis, said main roll having a groove for receiving the web of the brake shoe, lands on both sides of said groove against which the inner peripheral face of the rim is abuttable, and a pair of equal-diameter flanges, each of said flanges being fixed to an outer side of one of said lands and having a radially outward circumferential face, said lands being recessed radially inward relative to said circumferential faces of said flanges by a distance smaller than the thickness of the rim of the brake shoe;

a dependent roll pivotally carried by the base and positioned facing said main roll;

a dependent roll frame pivotally and rotatably supporting said dependent roll; and a hydraulic cylinder having a piston rod therein, said cylinder being fixed to said base and actuatable to move said dependent roll frame toward said main roll by movement of said piston rod, said piston rod maintaining said dependent roll in contact with said circumferential faces of said flanges until said main roll is rotated to place the rim of the brake shoe between said dependent roll and said main roll, said piston rod urging the rim against said lands at times when the rim is between said dependent roll and said main roll.

* * * * *